US011133126B2

(12) United States Patent
Jang et al.

(10) Patent No.: US 11,133,126 B2
(45) Date of Patent: Sep. 28, 2021

(54) COIL COMPONENT

(71) Applicant: SAMSUNG ELECTRO-MECHANICS CO., LTD., Suwon-Si (KR)

(72) Inventors: Su Bong Jang, Suwon-Si (KR); Min Ki Jung, Suwon-Si (KR); Sang Jong Lee, Suwon-Si (KR); Seung Hee Hong, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 222 days.

(21) Appl. No.: 16/029,224

(22) Filed: Jul. 6, 2018

(65) Prior Publication Data

US 2019/0096560 A1 Mar. 28, 2019

(30) Foreign Application Priority Data

Sep. 22, 2017 (KR) ..... 10-2017-0122568

(51) Int. Cl.
*H01F 27/29* (2006.01)
*H01F 17/00* (2006.01)
*H01F 17/02* (2006.01)

(52) U.S. Cl.
CPC ..... *H01F 17/0013* (2013.01); *H01F 17/02* (2013.01); *H01F 27/29* (2013.01); *H01F 27/292* (2013.01)

(58) Field of Classification Search
CPC ..... H01F 17/0013; H01F 17/02; H01F 2017/048; H01F 27/29; H01F 27/292; H01F 27/2804; H01F 2027/2809
(Continued)

(56) References Cited

U.S. PATENT DOCUMENTS 7,940,153 B2 * 5/2011 Watanabe ..... H01F 27/292 336/192
8,013,704 B2 * 9/2011 Kitajima ..... H01F 17/045 336/192
(Continued)

FOREIGN PATENT DOCUMENTS

JP 11-204337 A 7/1999
JP 2002-118022 A 4/2002
(Continued)

OTHER PUBLICATIONS

Office Action issued in Japanese Patent Application No. 2018-127333 dated Nov. 13, 2018, with English translation.
(Continued)

*Primary Examiner* — Mang Tin Bik Lian
*Assistant Examiner* — Mangtin Lian
(74) *Attorney, Agent, or Firm* — Morgan, Lewis & Bockius LLP

(57) ABSTRACT

A coil component includes a body including an internal coil and first and second external electrodes respectively disposed on outer surfaces of the body. The first and second external electrodes extend from a lower surface of the body to first and second end surfaces connected thereto, respectively. The first external electrode on the first end surface and the second external electrode on the second end surface each include a base portion and an extending portion extending from the base portion in a height direction, having a predetermined height, and having a width narrower than a width of the base portion.

22 Claims, 5 Drawing Sheets

(58) Field of Classification Search
USPC ..... 336/200, 192, 223
See application file for complete search history.

(56) References Cited

U.S. PATENT DOCUMENTS

| | | | | |
|---|---|---|---|---|
| 8,201,318 | B2 * | 6/2012 | Yamano | H01F 27/292 29/602.1 |
| 8,723,629 | B1 * | 5/2014 | Liu | H01F 27/29 336/83 |
| 9,536,653 | B2 * | 1/2017 | Yamada | H01F 41/071 |
| 9,613,753 | B2 * | 4/2017 | Maeda | H01G 4/232 |
| 9,984,809 | B2 * | 5/2018 | Wakamori | H01F 17/041 |
| 10,790,092 | B2 * | 9/2020 | Itamochi | H01G 4/248 |
| 2003/0179062 | A1 * | 9/2003 | Kuwata | H01F 17/045 336/83 |
| 2009/0184791 | A1 | 7/2009 | Fukui | |
| 2010/0123995 | A1 * | 5/2010 | Otsuka | H01G 4/232 361/308.1 |
| 2011/0260821 | A1 * | 10/2011 | Yamada | H01F 41/10 336/192 |
| 2013/0027161 | A1 * | 1/2013 | Urano | H01F 17/04 336/83 |
| 2014/0145815 | A1 * | 5/2014 | Ishii | H01F 27/292 336/200 |
| 2015/0371757 | A1 | 12/2015 | Takezawa | |
| 2016/0042858 | A1 | 2/2016 | Park et al. | |
| 2016/0099106 | A1 * | 4/2016 | Kurokawa | H01F 27/2804 361/301.4 |
| 2016/0225521 | A1 * | 8/2016 | Yamada | H01F 41/0246 |
| 2016/0247626 | A1 * | 8/2016 | Kawarai | H01F 27/24 |
| 2016/0307694 | A1 | 10/2016 | Ohtsubo et al. | |
| 2017/0018351 | A1 * | 1/2017 | Yatabe | H05K 3/3431 |
| 2017/0103847 | A1 * | 4/2017 | Park | H01F 27/292 |
| 2017/0207018 | A1 | 7/2017 | Jung | |
| 2017/0345558 | A1 * | 11/2017 | Sekiguchi | H01F 27/292 |
| 2018/0068780 | A1 * | 3/2018 | Shimoda | H01F 27/2804 |
| 2018/0090266 | A1 * | 3/2018 | Sano | H01F 41/043 |
| 2018/0096769 | A1 * | 4/2018 | Sekiguchi | H01F 5/04 |
| 2018/0247751 | A1 * | 8/2018 | Noya | H01F 27/2823 |
| 2018/0308621 | A1 * | 10/2018 | Tanaka | H01F 27/2823 |
| 2018/0308622 | A1 * | 10/2018 | Tanaka | H01F 27/022 |
| 2018/0308623 | A1 * | 10/2018 | Tanaka | H01F 27/292 |
| 2018/0308624 | A1 * | 10/2018 | Tanaka | H01F 27/2828 |
| 2018/0351526 | A1 * | 12/2018 | Miyoshi | H01G 4/40 |
| 2019/0051450 | A1 * | 2/2019 | Shimoda | H01F 27/2852 |
| 2019/0066912 | A1 * | 2/2019 | Takeda | H01F 27/292 |
| 2019/0088396 | A1 * | 3/2019 | Nakashima | H01F 27/292 |

FOREIGN PATENT DOCUMENTS

| | | | |
|---|---|---|---|
| JP | 2009-194364 | A | 8/2009 |
| JP | WO2015/115024 | A1 | 8/2015 |
| JP | 2016-119385 | A | 6/2016 |
| KR | 10-1999-0049588 | A | 7/1999 |
| KR | 10-2015-0089279 | A | 8/2015 |
| KR | 10-2016-0019265 | A | 2/2016 |
| KR | 10-2017-0032056 | A | 3/2017 |
| KR | 10-2017-0032057 | A | 3/2017 |

OTHER PUBLICATIONS

Office Action issued in corresponding Korean Patent Application No. 10-2017-0122568 dated Oct. 10, 2018.

* cited by examiner

C

II-II'

COIL COMPONENT

CROSS-REFERENCE TO RELATED APPLICATION

This application claims benefit of priority to Korean Patent Application No. 10-2017-0122568 filed on Sep. 22, 2017 in the Korean Intellectual Property Office, the disclosure of which is incorporated herein by reference in its entirety.

BACKGROUND

1. Field

The present disclosure relates to a coil component and, more particularly, to an inductor for a high frequency.

2. Description of Related Art

An inductor is an electronic component and a passive element that is used to remove noise by constituting an electronic circuit together with a resistor and a capacitor. Using electromagnetic characteristics, the inductor can be coupled to a capacitor to constitute a resonant circuit, a filter circuit, and the like, to amplify a signal within a specific frequency band. Smartphones configured to communicate using the LTE multi-band methods use signals in many frequency bands. Inductors are used in impedance matching circuits in such RF systems to transmit and receive high frequency signals, and the use of such high frequency inductors continues to increase. As the mounting space provided for inductors is reduced, demand for smaller and thinner passive elements has increased. Further, high-frequency chip inductors are commonly used at high frequencies of 100 MHz or higher due to a self resonant frequency (SRF) at a high frequency band and low resistivity on the basis of miniaturization. In addition, a high quality (Q) factor is requested to reduce loss at an application frequency.

SUMMARY

An aspect of the present disclosure may provide a coil component having a high quality (Q) factor in a high frequency environment.

According to an aspect of the present disclosure, a coil component may include a body having an internal coil including a first end and a second end and including an upper surface and a lower surface opposing each other in a thickness direction, a first end surface and a second end surface opposing each other in a length direction, and a first side surface and a second side surface opposing each other in a width direction. The coil component further includes first and second external electrodes respectively connected to the first and second ends and respectively disposed on the first end surface and the second end surface. The first external electrode includes a first base portion extending along the lower surface and the first end surface, and a first extending portion extending from the first base portion along the first end surface in the thickness direction. The second external electrode includes a second base portion extending along the lower surface and the second end surface, and a second extending portion extending from the second base portion along the second end surface in the thickness direction. In this case, a width of the first base portion is greater than a width of the first extending portion on the first end surface with respect to the width direction, and a width of the second base portion is greater than a width of the second extending portion on the second end surface with respect to the width direction. An end surface of the first extending portion is parallel to the first end surface and line-symmetrical with respect to a first central line corresponding to the center of the first end surface, and an end surface of the second extend portion is parallel to the second end surface and line-symmetrical with respect to a second central line corresponding to the center of the second end surface.

According to another aspect of the present disclosure, a coil component includes a body having an internal coil and first and second external electrodes disposed on opposing first and second surfaces of the body and connected to opposing ends of the internal coil. Each of the first and second external electrodes includes: a first portion having a first width, and a second portion having a second width lower than the first width, contacting the first portion, and spaced apart from edges of the respective first or second surface.

According to a further aspect of the present disclosure, a coil component includes a body having an internal coil and first and second external electrodes disposed on opposing first and second surfaces of the body and connected to opposing ends of the internal coil. Each of the first and second external electrodes includes: a first portion having a first width, and second and third portions each having a same second width lower than the first width, and spaced apart from each other to each contact the first portion.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Exemplary embodiments will now be described in detail with reference to the accompanying drawings.

Hereinafter, a coil component, in particular an inductor functioning at a high frequency according to an exemplary embodiment, will be described.

Figure 1:
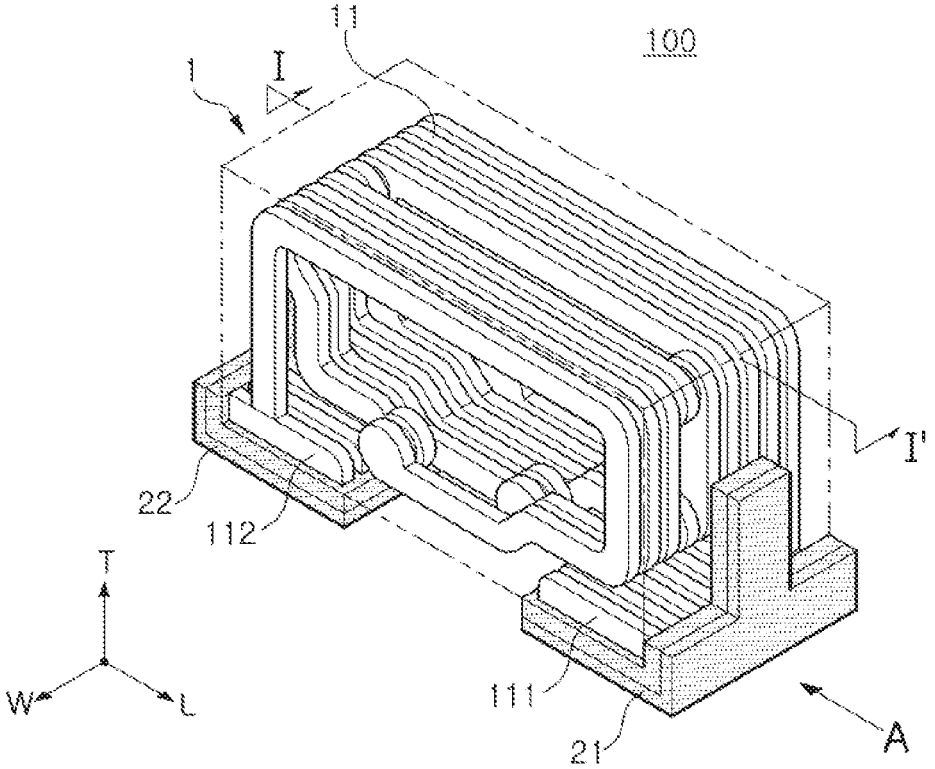
FIG. 1 is a schematic perspective view of a coil component according to an exemplary embodiment.
Figure 2:
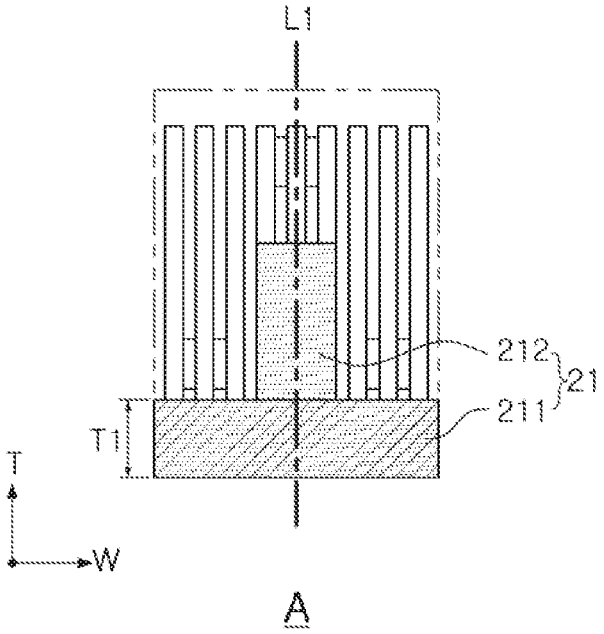
FIG. 2 is a planar view taken in the direction A of FIG. 1.

FIG. 1 is a schematic perspective view of a coil component 100 according to an exemplary embodiment, and FIG. 2 is a planar view taken in the direction A of FIG. 1, illustrating an example of a shape of a first external electrode of the coil component 100. Descriptions of the first external electrode in relation to FIG. 2 may also be applied as is to the second external electrode, and thus, a separate description of the second external electrode will be omitted. Also, FIG. 3 is a schematic cross-sectional view, taken along line I-I' of FIG. 1, and FIG. 4 is a schematic cross-sectional view of the coil component according to a modification of FIG. 3.

Figure 3:
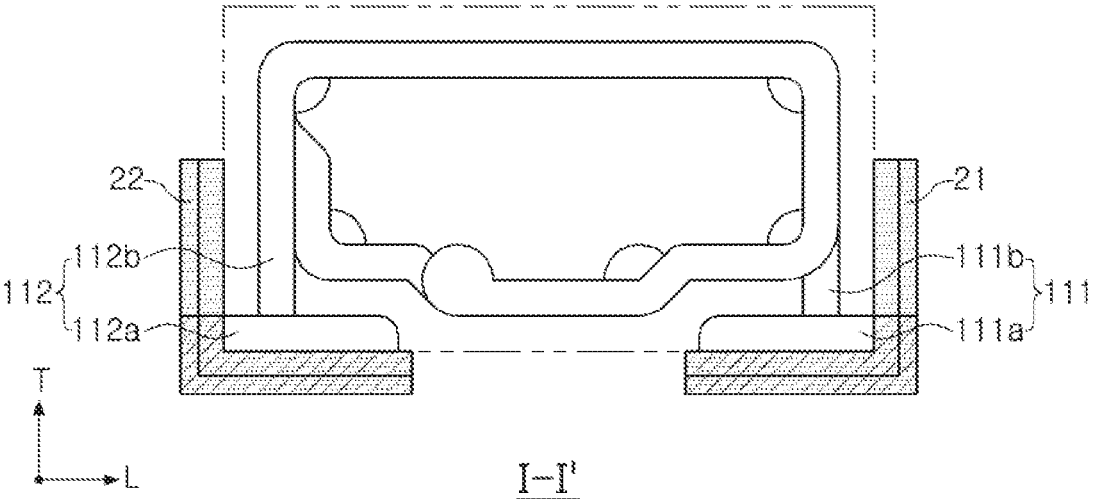
FIG. 3 is a schematic cross-sectional view, taken along line I-I' of FIG. 1.
Figure 4:
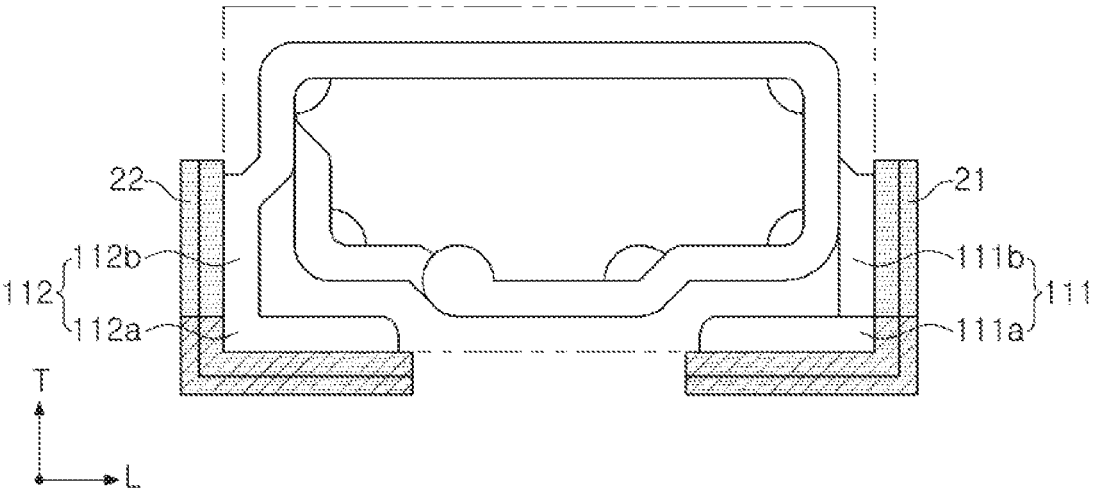
FIG. 4 is a schematic cross-sectional view of the coil component according to a modification of FIG. 3.

Referring first to FIGS. 1, 2, and 3, the coil component 100 according to an exemplary embodiment includes a body 1 and first and second external electrodes 21 and 22.

The body 1 substantially determines an appearance of the coil component 100. The body 1 has an upper surface and a lower surface opposing each other in the thickness direction T, a first end surface and a second end surface opposing each other in the length direction L, and a first side surface and a second side surface opposing each other in the width direction W, having a substantially hexahedral shape, but is not limited thereto.

A material to form the body 1 may be appropriately selected by a person skilled in the art in consideration of a characteristic value to be realized by the coil component 100. In particular, when the coil component 100 is applied to a high frequency inductor, ceramic powder, or the like, may be used because a closed magnetic circuit is to be formed using a dielectric material. There is no limitation in a manufacturing method of the body 1. For example, a lamination method may be used by stacking a plurality of dielectric sheets, disposing a conductive material to form an internal coil pattern on each sheet, and connecting the internal coil patterns through vias. Alternatively, a method of sealing a previously manufactured spiral internal coil with a dielectric material, or the like, may be used to embed the internal coil.

An internal coil 11 is disposed on the inner side of the body 1. The internal coil 11 includes a central core disposed to extend in a horizontal direction with respect to a lower surface of the body 1, i.e., a mounting surface when the coil component is mounted on a printed circuit board (PCB), or the like. The core may extend through a central opening of windings of the internal coil 11. Here, inductance may be increased and a self-resonance frequency may be increased through the use of the central core C.

The internal coil 11 includes a first end 111 and a second end 112, and includes a main body connecting the first and second ends 111 and 112. The first and second ends 111 and 112 serve to connect the internal coil with external electrodes and external electronic components. The first end 111 includes a first lower surface exposed portion 111*a* and a first connection portion 111*b* substantially vertically connected to the first lower surface exposed portion 111*a*. When the first end 111 is connected to the first external electrode 21, the first lower surface exposed portion 111*a* is in direct contact with the first external electrode 21 and the first connection portion 111*b* is embedded inside of the body 1 and is not exposed to the outside.

FIG. 4 illustrates a modification of FIG. 3. Referring to FIG. 4, the structure may be changed to be designed such that the first connection portion 111*b* is exposed to the first end surface of the body so as to be in direct contact with the first external electrode 21. This may be selected by a person skilled in the art in consideration of a required specification of an internal coil (for example, the number of turns of the internal coil). In the case of the structure of the first connection portion 111*b* of FIG. 4, the first connection portion 111*b*, as well as the first lower surface exposed portion 111*a*, are indirect contact with the first external electrode 21, as compared with the structure of the first connection portion of the internal coil illustrated in FIG. 3. In this way a contact area between the internal coil and the external electrode may be increased to result in improvement of a contact force and Rdc characteristics of the coil component.

Referring back to FIGS. 1 through 3, the first external electrode 21 extends from a lower surface of the body 1 to the first end surface. A length of the first external electrode 21 extending along the lower surface of the body may be longer than a length of the first lower surface exposed portion 111*a* of the internal coil exposed to the lower surface of the body 1, a length of the first external electrode 21 extending on the first end surface of the body may only need to be so long as it can strengthen adhesion when the external electrode 21 is soldered, and the first external electrode 21 may be disposed not to be in contact with an edge between the upper surface of the body and the first end surface. If the first external electrode 21 is in contact with the edge formed by the upper surface of the body and the first end surface, loss of a Q factor may be made due to blocking a magnetic flux based on an induced current generated from a conductor of the first external electrode 21 as in a configuration in which the first external electrode 21 has a shape of "ㄷ", a Korean consonant. Thus, the length of the first external electrode 21 extending on the first end surface of the body may be minimized while nonetheless maintaining a sufficient length thereof advantageous for soldering the external electrode, as compared with a case in which only the external electrode is formed as a bottom electrode. For example, the first external electrode 21 may extend only to a position lower than a half of a height of the first end surface of the body 1.

The first external electrode 21 has a substantially L-shape but a specific structure thereof is different from a general L-shaped electrode. In the case of the general L-shaped electrode, the first external electrode 21 is formed to have the same width (e.g., measured in the W direction) when extended from the lower surface of the body to the first end surface. However, in the present case, as the first external electrode 21 extends from the lower surface of the body along the first end surface, a same/constant width is maintained such that the first external electrode 21 maintains the same width up to a height T1 measured along the first end surface. Above the height T1, the width may become narrower. As a result, the first external electrode disposed on the first end surface roughly has a shape of "ㅗ", a Korean vowel, in the T-W plane.

In this manner, the first external electrode 21 has a first base portion 211 (see, e.g., FIG. 2) extending from the lower surface of the body to a predetermined height T1 of the first end surface and having a relatively large width, and a first extending portion 212 having a relatively narrow width disposed above the first base portion 211 on the first end surface. For the purposes of description, the first base portion 211 and the first extending portion 212 are distinguishably illustrated as separate components in terms of structure, but a boundary therebetween in appearance is not essential.

An end surface of the first base portion 211 is substantially a rectangle and a length of an edge thereof is substantially equal to a length of the lower surface of the body extending in the width direction. Actually, the first base portion 211 is in direct contact with the entirety of the first lower surface exposed portion 111*a* of the first end of the internal coil and at least a portion of the first connection portion 111*b*, while the first extending portion 212 is directly (See FIG. 4) or indirectly (See FIG. 3) connected to at least a portion of the first connection portion 111*b* selectively.

Also, the first external electrode 21 may have an end surface structure line-symmetrical with respect to a first central line L1 (see, e.g., FIG. 2) that is parallel to the thickness direction and corresponds to the center of the first end surface. In the case of having the line-symmetrical end surface structure, the external electrode may be stably adhered when soldered and unbalance of magnetic flux blocking may not occur in terms of electrical characteristics of the coil component, preventing loss of a Q factor.

In this manner, since the first and second external electrodes 21 and 22 of the coil component 100 are each formed to substantially have a concave-convex structure, a problem (defective mounting, difficulty in inspecting appearance, etc.) of a general bottom electrode may be solved, while obtaining an excellent general effect (high Q factor) of the bottom surface, compared with a general C-shaped electrode. In detail, the coil component 100 has a Q value substantially equal to that of a high-frequency inductor having the bottom electrode and has a Q value significantly higher than that of the high-frequency inductor having the L-shaped electrode. In addition, the coil component 100 may exhibit effects such as improvement of defective mounting, improvement of a contact force between the external electrode and the internal coil, and ease of inspection of an appearance after SMT, compared with the high frequency inductor having the bottom electrode.

Figure 5:
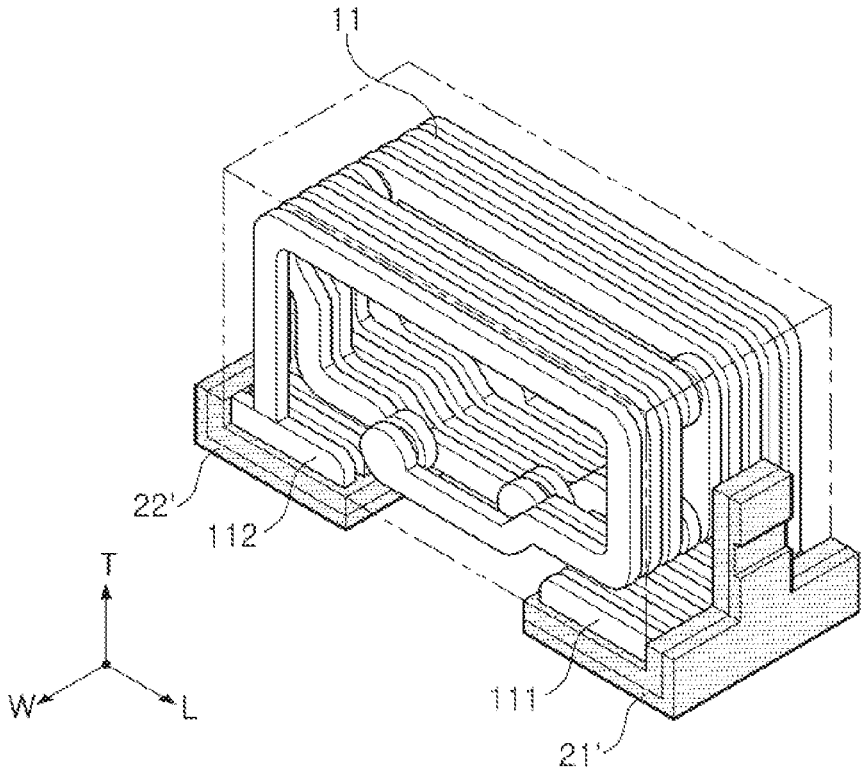
FIG. 5 is a schematic perspective view of the coil component of FIG. 1 in which a shape of an outer portion of an external electrode is modified.

For reference, a coil component of FIG. 5 has substantially the same structure as that of the coil component 100 of FIG. 1, except for a bent portion present on an exposed surface of first and second external electrodes 21' and 22'. Due to the bent portion on the exposed surface of the first and second external electrodes 21' and 22', an overall bonding area which can be soldered may be increased and adhesion may be improved.

Figure 6:
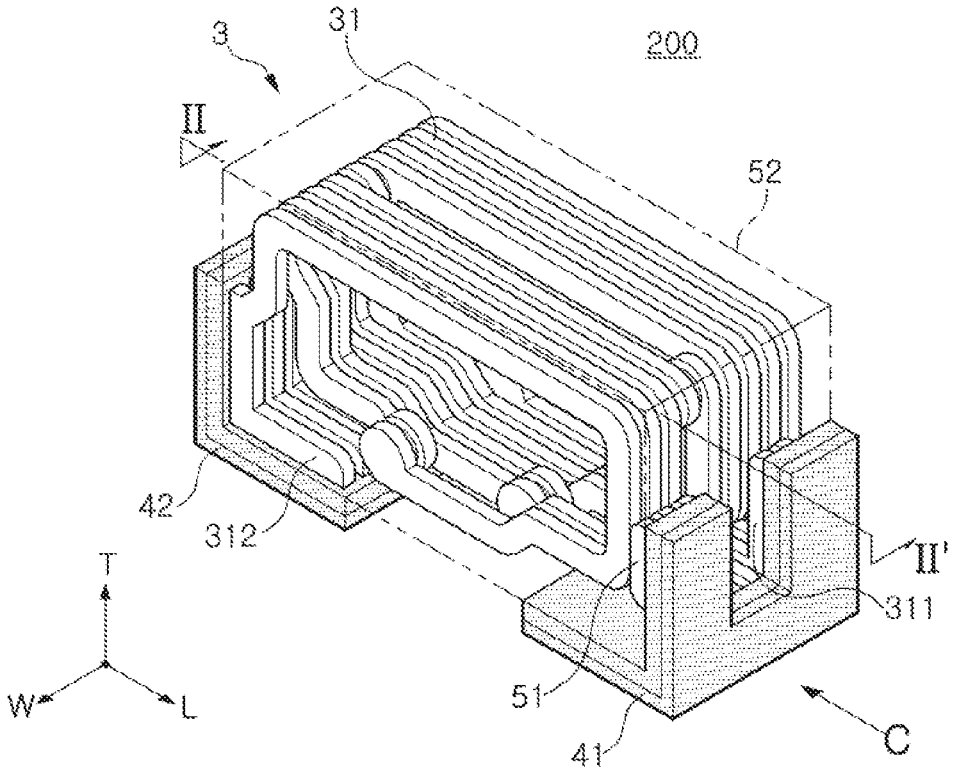
FIG. 6 is a schematic perspective view of a coil component according to a modification of the coil component of FIG. 1.

FIG. 6 is a schematic perspective view of a coil component 200 according to a modification of the coil component 100 illustrated in FIG. 1. Also, FIG. 7 is a planar view of the coil component of FIG. 6 when viewed in a direction C, and FIG. 8 is a schematic cross-sectional view, taken along line II-II' of FIG. 6.

Figure 7:
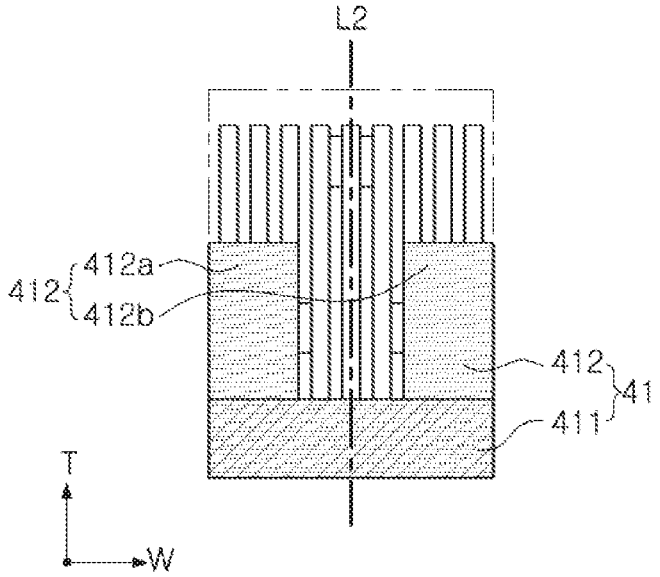
FIG. 7 is a planar view taken in a direction C in FIG. 6.
Figure 8:
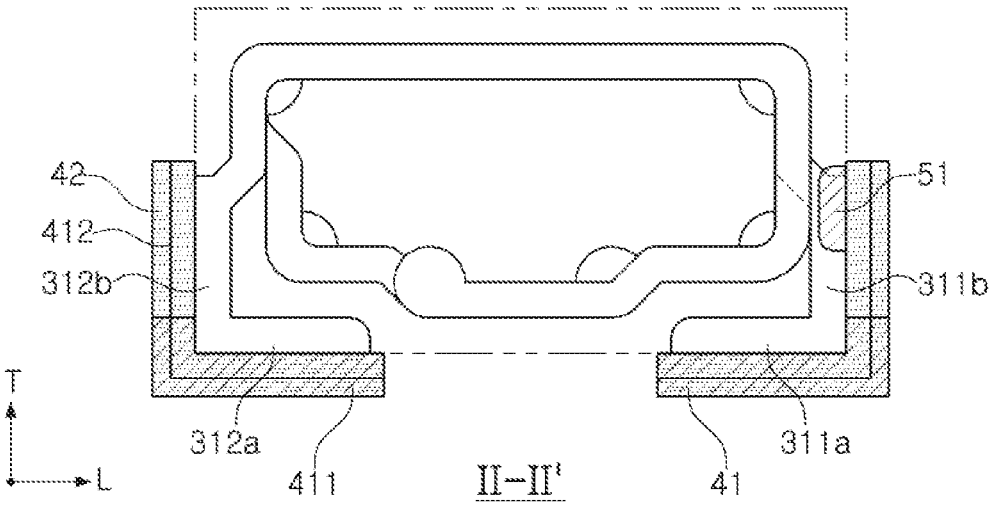
FIG. 8 is a schematic cross-sectional view, taken along line II-II' of FIG. 6.

The coil component 200 illustrated in FIGS. 6 through 8 is different from the above-described coil component 100 in the structure of external electrodes and the ends of the internal coil. Hereinafter, for purposes of description, redundant description of the same components as those of the coil components described above with reference to FIGS. 1 through 5 will be omitted.

Referring to FIGS. 6 through 8, the coil component 200 includes a body 3 (an outline of which is illustratively shown by dash-dot outline 52) and first and second external electrodes 41, 42 on outer surfaces of the body 3. The body 3 includes a sealing material of a dielectric material or a magnetic material and includes an internal coil 31 sealed by the sealing material. The body 3 further includes a first dummy electrode 51 exposed to the first end surface, and a second dummy electrode disposed symmetrically to the first dummy electrode 51 with respect to a center point of the body 3 and exposed to the second end surface. The first dummy electrode 51 and second dummy electrode are physically spaced apart from the internal coil 31 and serve to improve adhesion of the first and second external electrodes 41 and 42 with respect to the body 3. Since the first dummy electrode 51 and second dummy electrode may only need to serve to improve adhesion of the first and second external electrodes 41 and 42 with respect to the body 3, there is no restriction in a specific end surface shape thereof, but, for example, the dummy electrodes may be rectangular or may have only a curved portion. In addition, since the first and second dummy electrodes are connected to the first and second external electrodes 41 and 42, respectively, the dummy electrodes may include a conductive material.

The internal coil 31 includes a first end 311 and a second end 312, and the first and second ends 311 and 312 are connected to the first and second external electrodes 41 and 42, respectively. Referring to the first end 311 of the internal coil 31, the first end 311 includes a first lower surface exposed portion 311*a* exposed to a lower surface of the body and a first connection portion 311*b* extending perpendicularly to the first lower surface exposed portion 311*a*. Both the first lower surface exposed portion 311*a* and the first connection portion 311*b* are in direct contact with the first external electrode 41. Similarly, referring to the second end 312 of the internal coil 31, the second end 312 includes a second lower surface exposed portion 312*a* exposed to a lower surface of the body and a second connection portion 312*b* extending perpendicularly to the second lower surface exposed portion 312*a* and in direct contact with the second external electrode 42.

A portion of the first external electrode 41 which is in direct contact with the first lower surface exposed portion 311*a* and a portion of the first connection portion 311*b* will be referred to as a first base portion 411, and a portion extending from the first base portion 411 in the thickness direction so as to be in direct contact with a portion of the first connection portion 311*b* will be referred to as a first extending portion 412. In the first external electrode 41 including the first base portion 411 and the first extending portion 412, an end surface of the first extending portion 412 is line-symmetrical with respect to a first central line L2 corresponding to the center of the first end surface. In detail, the first extending portion 412 includes a first bonding portion 412*a* and a second bonding portion 412*b* spaced apart from each other in the width direction, and the first bonding portion 412*a* and the second bonding portion 412*b* are in line-symmetrical positions with respect to each other relative to the first central line L2.

The second bonding portion 412*b* is in direct contact with the first end 311 of the internal coil 31, while the first bonding portion 412*a* is physically spaced apart from the internal coil 31 and is in direct contact with the dummy electrode 51 exposed to the first end surface of the body 3. Since the first external electrode 41 includes the first bonding portion 412*a* and the second bonding portion 412*b*, when the coil component is soldered to an external component, a soldering area may be increased and bonding strength with the body 3 may also be improved.

Meanwhile, although a detailed description is omitted, the description of the first external electrode 41 may be applied as is to the second external electrode 42.

When the coil component 100 or 200 described above is used, a contact force between the external electrodes and an external component is improved when the coil component is mounted, and a Q factor, the main characteristic value in the high frequency inductor, may be maintained at the same level as that of the bottom electrode. Further, although an appearance inspection is performed after the coil component is mounted, a difficulty in identifying the coil component, which is problematic in the coil component having the bottom surface, may be solved.

As set forth above, according to exemplary embodiments, the coil component having a high Q factor may be provided by controlling a shape of the external electrodes.

While exemplary embodiments have been shown and described above, it will be apparent to those skilled in the art that modifications and variations could be made without departing from the scope of the present invention as defined by the appended claims.

What is claimed is:

1. A coil component comprising:

a body having an internal coil including a first end and a second end and including an upper surface and a lower surface opposing each other in a thickness direction, a first end surface and a second end surface opposing each other in a length direction, and a first side surface and a second side surface opposing each other in a width direction; and first and second external electrodes respectively connected to the first and second ends, wherein the first external electrode includes a first base portion disposed on and extending along the lower surface and the first end surface, and a first extending portion extending from the first base portion along the first end surface in the thickness direction, the second external electrode includes a second base portion disposed on and extending along the lower surface and the second end surface, and a second extending portion extending from the second base portion along the second end surface in the thickness direction, a width of the first base portion extends across a full width of the first end surface of the body, and is greater than a width of the first extending portion on the first end surface with respect to the width direction, a width of the second base portion extends across a full width of the second end surface of the body, and is greater than a width of the second extending portion on the second end surface with respect to the width direction, an end surface of the first extending portion is parallel to the first end surface and line-symmetrical with respect to a first central line corresponding to the center of the first end surface, and an end surface of the second extend portion is parallel to the second end surface and line-symmetrical with respect to a second central line corresponding to the center of the second end surface, at least one of the first or second extending portions includes an opening therein which respectively exposes a portion of the first or second end surface from an entire width of the opening, and at least one of the first or second extending portions comprises two or less extending portions.

2. The coil component of claim 1, wherein an end surface of the first base portion disposed on the first end surface has a rectangular shape and extends from a lower edge of the first end surface by a predetermined height in the thickness direction, and an end surface of the second base portion disposed on the second end surface has a rectangular shape and extends from a lower edge of the second end surface by a predetermined height in the thickness direction.

3. The coil component of claim 1, wherein a coil axis of the internal coil is parallel to the lower surface.

4. The coil component of claim 1, wherein the first end of the internal coil includes a first lower surface exposed portion exposed to the lower surface and a first connection portion connected thereto, and a width of the first lower surface exposed portion is smaller than the width of the first base portion with respect to the width direction, and the second end of the internal coil includes a second lower surface exposed portion exposed to the lower surface and a second connection portion connected thereto, and a width of the second lower surface exposed portion is smaller than the width of the second base portion with respect to the width direction.

5. The coil component of claim 4, wherein the first lower surface exposed portion is in direct contact with the first external electrode, and the second lower surface exposed portion is in direct contact with the second external electrode.

6. The coil component of claim 4, wherein the first connection portion extends perpendicularly to the lower surface of the body and is spaced apart by a predetermined interval from the first end surface of the body, and the second connection portion extends perpendicularly to the lower surface of the body and is spaced apart by a predetermined interval from the second end surface of the body.

7. The coil component of claim 4, wherein the first connection portion extends perpendicularly to the lower surface of the body and is exposed to the first end surface of the body, and the second connection portion extends perpendicularly to the lower surface of the body and is exposed to the second end surface of the body.

8. The coil component of claim 7, wherein a surface of the first connection portion exposed to the first end surface is in contact with the first external electrode, and a surface of the second connection portion exposed to the second end surface is in contact with the second external electrode.

9. The coil component of claim 4, wherein the first and second connection portions face each other and are arranged to be offset from each other by a predetermined interval with respect to the width direction.

10. The coil component of claim 1, wherein the first extending portion extends from the first base portion only up to a position lower than the upper surface of the body, and the second extending portion extends from the second base portion only up to a position lower than the upper surface of the body.

11. The coil component of claim 1, wherein the first extending portion includes a first bonding portion and a second bonding portion spaced apart from each other in the width direction, and the second extending portion includes a third bonding portion and a fourth bonding portion spaced apart from each other in the width direction.

12. The coil component of claim 11, wherein end surfaces of the first and second bonding portions have a polygonal shape, and end surfaces of the third and fourth bonding portions have a polygonal shape.

13. The coil component of claim 11, wherein at least one of the first and second bonding portions is exposed to the first end surface and is in direct contact with a dummy electrode spaced apart from the internal coil, and at least one of the third and fourth bonding portions is exposed to the second end surface and is in direct contact with a dummy electrode spaced apart from the internal coil.

14. The coil component of claim 13, wherein the dummy electrode includes a conductive material.

15. The coil component of claim 1, wherein a bent portion is formed on a surface of each of the first and second external electrodes.

16. The coil component of claim 1, wherein a minimum height by which the first external electrode extends on the first end surface is greater than a maximum height at which the first end is exposed from the first end surface, and a minimum height by which the second external electrode extends on the second end surface is greater than a maximum height at which the second end is exposed from the second end surface.

17. A coil component comprising:

a body having an internal coil; and first and second external electrodes disposed on opposing first and second surfaces of the body and connected to opposing ends of the internal coil, wherein at least one of the first or second external electrodes includes:

a first portion having a first width and disposed on and extending across a full width of the respective first or second surface of the body, a second portion having a second width lower than the first width, contacting the first portion, and spaced apart from edges of the respective first or second surface, and the second portion includes only first and second extending portions which are spaced apart from each other so as to expose therethrough a portion of the first or second surface of the body extending from the first extending portion to the second extending portion.

18. The coil component of claim 17, wherein the first and second external electrodes are each further disposed on a third surface of the body, and each extend from the third surface to a respective one of the first and second surfaces of the body.

19. The coil component of claim 18, wherein the first portion of each of the first and second external electrodes contacts an edge common to the respective one of the first and second surfaces of the body and the third surface of the body, each second portion has the second width, measured in a width direction parallel to the edge common to the respective one of the first and second surfaces and the third surface, lower than the first width, measured in the width direction parallel to the second width, of the respective one of the first and second surfaces, and each second portion is centered in the width direction on the respective one of the first and second surfaces.

20. A coil component comprising:

a body having an internal coil; and first and second external electrodes disposed on opposing first and second surfaces of the body and connected to opposing ends of the internal coil, wherein at least one of the first or second external electrodes includes:

a first portion having a first width and disposed on and extending across a full width of the respective first or second surface of the body, second and third portions each having a second width lower than the first width, and each in contact with the first portion, and wherein only the second and third portions are spaced apart from each other so as to expose therethrough a portion of the first or second surface of the body extending from the second portion to the third portion.

21. The coil component of claim 20, wherein the first and second external electrodes are each further disposed on a third surface of the body, and each extend from the third surface to a respective one of the first and second surfaces of the body.

22. The coil component of claim 21, wherein the first portion of each of the first and second external electrodes contacts an edge common to the respective one of the first and second surfaces of the body and the third surface of the body, each second and third portion has the same second width, measured in a width direction parallel to the edge common to the respective one of the first and second surfaces and the third surface, and the second width is lower than the first width, measured in the width direction parallel to the second width, of the respective one of the first and second surfaces, and each second and third portion contacts an edge of the respective first portion opposite to the edge common to the respective one of the first and second surfaces and the third surface.

* * * * *